United States Patent [19]

Whatley, II

[11] Patent Number: 5,076,175

[45] Date of Patent: Dec. 31, 1991

[54] PROTECTIVE PLATE FOR FORK-LIFT PALLETS

[76] Inventor: Thomas F. Whatley, II, P.O. Box 895, Mabank, Tex. 75147

[21] Appl. No.: 686,302

[22] Filed: Apr. 16, 1991

Related U.S. Application Data

[63] Continuation of Ser. No. 554,692, Jul. 18, 1990, abandoned.

[51] Int. Cl.[5] ..... B65D 19/38

[52] U.S. Cl. ..... 108/51.1; 108/57.1; 52/DIG. 6

[58] Field of Search ..... 108/51.1, 51.3, 52.1, 108/56.3; 52/DIG. 6

[56] References Cited

U.S. PATENT DOCUMENTS

| | | | |
|---|---|---|---|
| D. 286,855 | 11/1986 | Paul | D8/389 |
| D. 287,223 | 12/1986 | Paul | D8/389 |
| 2,651,486 | 9/1953 | Woodward | 248/120 |
| 2,817,485 | 12/1957 | White et al. | 248/120 |
| 2,823,883 | 2/1958 | Bourdon | 248/120 |
| 3,011,226 | 12/1961 | Menge | 108/51.1 |
| 3,645,215 | 2/1972 | Kirkpatrick | 108/51 |
| 3,823,522 | 7/1974 | Jureit et al. | 52/641 |
| 3,861,094 | 1/1975 | Jureit et al. | 52/86 |
| 4,292,899 | 10/1981 | Steffen | 108/51.1 |
| 4,385,564 | 5/1983 | Heggenstaller | 108/51.1 |
| 4,455,805 | 6/1984 | Rionda et al. | 52/712 |
| 4,464,885 | 8/1984 | Palacio et al. | 52/693 |
| 4,483,120 | 11/1984 | Gottlieb | 52/693 |
| 4,485,606 | 12/1984 | Gottlieb | 52/694 |
| 4,490,956 | 1/1985 | Palacio et al. | 52/639 |
| 4,525,972 | 7/1985 | Palacio et al. | 52/643 |
| 4,541,218 | 9/1985 | Gottlieb | 52/694 |
| 4,546,579 | 10/1985 | Rionda et al. | 52/92 |
| 4,549,838 | 10/1985 | Birckhead | 411/468 |
| 4,555,887 | 12/1985 | Rionda et al. | 52/712 |
| 4,561,230 | 12/1985 | Rionda et al. | 52/289 |
| 4,562,683 | 1/1986 | Gottlieb | 52/693 |
| 4,570,407 | 2/1986 | Palacio et al. | 52/693 |
| 4,586,550 | 5/1986 | Kitipornchai | 52/DIG. 6 |
| 4,630,424 | 12/1986 | Eberle et al. | 52/DIG. 6 |
| 4,665,677 | 5/1987 | Palacio et al. | 52/693 |
| 4,715,294 | 12/1987 | Depew | 108/51.1 |
| 4,782,641 | 11/1988 | Manenti et al. | 52/639 |

*Primary Examiner*—Kenneth J. Dorner
*Assistant Examiner*—Gerald A. Anderson
*Attorney, Agent, or Firm*—Ross, Howison, Clapp & Korn

[57] ABSTRACT

A protective plate for use with a fork-lift pallet having an elongated horizontal wooden stringer having an inverted U-shaped opening including a curvilinear portion. The plate includes a side portion to protectively overlie a side of the stringer opening and a top portion to protectively overlie above the stringer opening. The plate affords entry of the fork-lift truck tine into the stringer opening. An arcuate portion interconnects the plate side portion and the plate top portion for location adjacent to the curvilinear portion of the U-shaped opening of the stringer.

4 Claims, 1 Drawing Sheet

PROTECTIVE PLATE FOR FORK-LIFT PALLETS

This application is a continuation of application Ser. No. 554,692 filed Jul. 18, 1990, now abandoned.

TECHNICAL FIELD OF THE INVENTION

This invention relates to plates, and more particularly to a protective plate for a wooden pallet.

BACKGROUND OF THE INVENTION

The use of fork-lifts and pallets for handling materials is well known. A typical fork-lift is a vehicle having at its front end a mast and hoist structure, at the lower end of which is a fork comprising a pair of horizontal, forwardly extending tines insertable beneath a load. The hoist is used to raise the load and the fork-lift truck carries the load to an unloading point. Pallets are used for receiving the load initially so as to permit the handling of heavy and bulky loads or to enable the stacking of several articles to comprise the load. Normally the load and pallet are shipped as a unit.

A conventional pallet is a wooden structure made up of several parallel, horizontal stringers and several cross boards, all nailed together to form a rectangular element. In two-way pallets, the fork tines enter between the stringers and engage the cross boards from below. In a four-way pallet, the stringers are cut out in two areas each to provide inverted U-shaped openings spaced apart to receive the fork. The fork may enter, selectively, from any of the four sides of the pallet, whereas in the two-way pallet entry can occur from only two opposite sides.

All conventional pallets are not exactly alike, but are dimensioned so as to accommodate most fork-lifts. The fork entry openings are made wide enough to accommodate different tine spacings as well as to enable easy entry without precise maneuvering of the fork-lift. Nevertheless, it is not always easy for the fork-lift operator to view the entry openings and consequently, the tips of the tines engage the stringers out of registration with the openings, resulting in damage to the stringers such that they must be repaired, replaced or the pallet discarded, all of which leads to excessive cost and downtime. Additionally, breakage of the stringers occurs due to radial cracks occurring at the corners of the stringer openings caused by the fork-lift tines as well as stresses caused by the load on the stringers.

A need has thus arisen for a device for the protection of stringers in the areas of the openings for fork tine entry in a pallet and more specifically, for a plate for preventing and/or substantially minimizing radial breakage at the corners of stringers in the areas of fork tine entry.

SUMMARY OF THE INVENTION

In accordance with the present invention, a protective plate is provided for use with a fork-lift pallet having an elongated horizontal wooden stringer provided with an inverted U-shaped opening including a curvilinear portion. The plate includes a side portion to protectively overlie a side of the stringer opening and a top portion to protectively overlie above the stringer opening. The plate affords entry of the fork-lift truck tine into the stringer opening. An arcuate portion interconnects the plate side portion and the plate top portion for location adjacent to the curvilinear portion of the U-shaped opening of the stringer.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
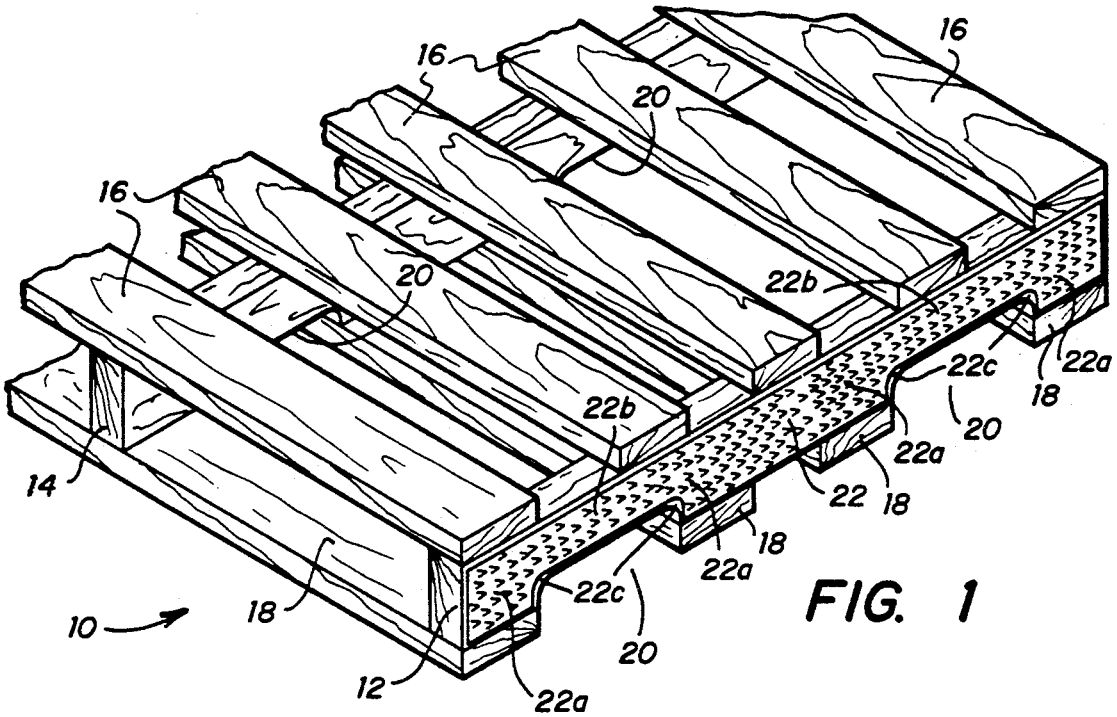
FIG. 1 is a fragmentary perspective view of a typical pallet showing one embodiment of the present plate.

Referring to FIG. 1, a conventional pallet is illustrated, and is generally identified by the numeral 10. Pallet 10 includes stringers 12 and 14 which are horizontal and parallel and are spaced apart according to fork-lift tine spacing. A third stringer is not illustrated in FIG. 1 which would typically comprise pallet 10. Stringers 12 and 14 are rigidly, cross-connected by top and bottom boards 16 and 18, respectively. When pallet 10 is entered by the fork-lift from the sides, the tines enter between stringers 12 and 14 and engage beneath the top cross boards 16. In a four-way pallet, which is shown in FIG. 1, fork-lift entry is permitted from either end of pallet 10 as well as from the sides, each stringer 12, 14 being cut out to provide a pair of inverted U-shaped openings 20. Openings 20 are spaced apart and dimensioned to receive the fork-lift tines. When the fork enters the openings 20, the tines engage beneath the upper portions of openings 20. Since stringers 12 and 14 are aligned, a pair of tunnels is formed within pallet 10 for receiving the fork.

A fork-lift operator may not always properly align the fork with openings 20, and therefore the tips of the tines engage areas of stringer 12 bordering openings 20, to either side of an opening 20 or above an opening 20. Stringer 12 may therefore incur damage, such as splintering, denting, wear and cracking at the corners of openings 20. According to the present invention, damage can be eliminated on new pallets, and used pallets can be reclaimed. In accordance with the present invention as illustrated in FIG. 1, a continuous plate 22 is affixed to the outer face of stringer 12 at the fork tine entry areas. It is also possible to add plate 22 to the inner face of stringer 12 as well as to both faces of stringer 14.

Stringer 22 includes side portions **22*a* which are disposed adjacent to the sides of openings 20 and portions 22*b* which are disposed above openings 20. An important aspect of the present invention is the use of an arcuate area 22*c* which interconnects portions 22*a* and 22*b*. Arcuate portion 22*c* may have a radius of, for example, one-half inch and conforms to the radius of opening 20 to thereby prevent radial breakage through out stringer 12 in the area defined by openings 20. Plate 22 of FIG. 1 completely covers the entire outer face of stringer 12**.

Figure 2:
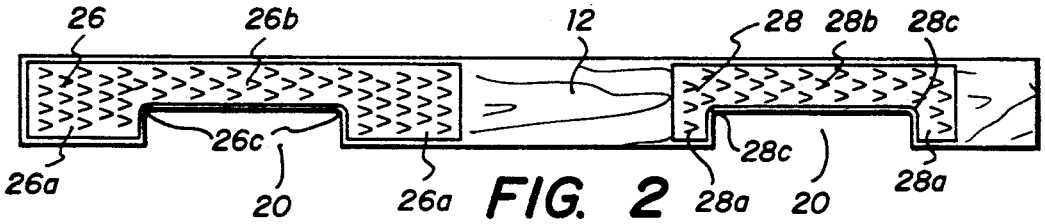
FIG. 2 is a side elevational view of a pallet illustrating two additional embodiments of the present plate.

FIG. 2 illustrates plates 26 and 28 positioned around openings 20 of stringer 12. Plate 26 includes side portions **26*a*, a top portion 26*b* and arcuate portions 26*c*. Plate 28 includes side portions 28*a*, a top portion 28*b* and arcuate portions 28*c***.

Figure 3:
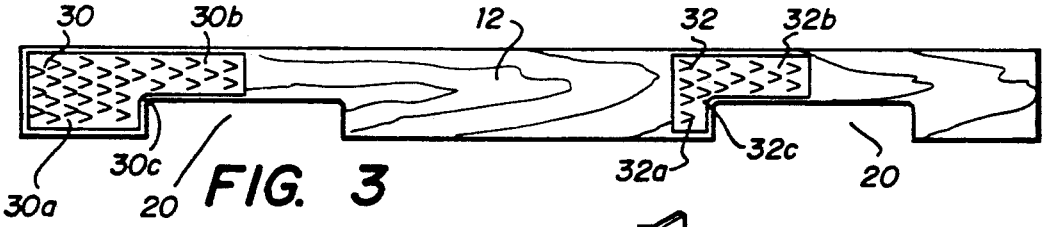
FIG. 3 is a side elevational view of a pallet illustrating two additional embodiments of the present plate.

FIG. 3 illustrates further embodiments of the present invention including plates 30 and 32. Plate 30 includes a side portion 30*a*, a top portion 30*b* and an arcuate portions 30*c* disposed around opening 20 of stringer 12. Plate 32 includes a side portion 32*a*, a top portion 32*b* and an arcuate portion 32*c* and as disposed around opening 20 of stringer 12. The particular selection of plates 26, 28, 30, and 32 depends upon the amount of reinforcing material required for the particular pallet 10 application as well as the amount of protection required around openings 20 of a stringer for use with pallet 10.

Figure 4:
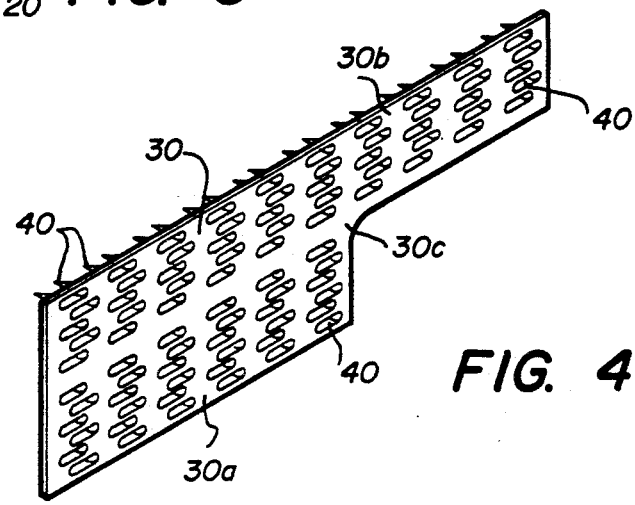
FIG. 4 is a perspective view of a plate illustrated in FIG. 3 in accordance with the present invention.

FIG. 4 illustrates, in more detail, plate 30 of FIG. 3. Plate 30 as well as plates 22, 26, 28, and 32 include perforated tines 40 which may be formed, for example, by a stamping operation. Tines 40 are utilized for engaging the stringers of pallet 10 for attaching plates 22, 26, 28, 30 and 32 to stringers 12. Additionally, plates 22, 26, 28, 30, and 32 may include perforations or holes to receive fasteners, such as for example, nails for the affixation of each plate to a stringer. The plates of the present invention may be fabricated from sheet metal, of about, for example, 20 gauge.

It therefore can be seen that the present protective plates for a fork-lift pallet provide for side and top protection for a stringer adjacent to the fork lift tine openings as well as providing protection for the radial area and radial breakage in the area of the stringer openings. The present plates can be readily attached to a stringer utilizing perforated tines as well as other mechanical fastening devices.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. A protective plate attached to a fork-lift pallet, said pallet having an elongated horizontal wooden stringer provided with an inverted U-shaped opening including a curvilinear portion at the corners of the opening for affording entry of a tine of a fork-lift truck, comprising said plate:

a side portion protecting the stringer beside the opening and a top portion protecting the stringer above the opening, said plate affording entry of the fork-lift tine into the stringer opening;

an arcuate portion interconnecting said plate side portion and said plate top portion protecting a corner of the U-shaped opening of the stringer; and means for attaching said plate to the stringer including a plurality of perforated tines formed in said plate, said plurality of perforated tines being disposed adjacent said arcuate portion and throughout said plate side portion and said plate top portion for positive attachment of the plate to the corner of the U-shaped opening of the stringer, such that said arcuate portion and said positive attachment created by said plurality of tines disposed adjacent said arcuate portion provide protection against radial breakage and damage in the area of the corners of the stringer.

2. The protective plate of claim 1 wherein said plate side portion overlies both sides of the stringer opening.

3. The protective plate of claim 1 wherein said plate top portion overlies above the entire stringer opening.

4. The protective plate of claim 1 wherein said plate overlies the entire stringer.

* * * * *

UNITED STATES PATENT AND TRADEMARK OFFICE

CERTIFICATE OF CORRECTION

PATENT NO. : 5,076,175

DATED : DECEMBER 31, 1991

INVENTOR(S) : THOMAS F. WHATLEY, II

It is certified that error appears in the above-identified patent and that said Letters Patent is hereby corrected as shown below:

Column 4, line 8, before "comprising" insert -- said plate --.

Column 4, line 9, delete "said plate".

Signed and Sealed this

Thirtieth Day of March, 1993

*Attest:*

STEPHEN G. KUNIN

*Attesting Officer*

*Acting Commissioner of Patents and Trademarks*